US008791822B2

(12) United States Patent
Delia et al.

(10) Patent No.: US 8,791,822 B2
(45) Date of Patent: Jul. 29, 2014

(54) EMBEDDED RFID VERIFIABLE CURRENCY

(75) Inventors: Wayne M. Delia, Poughkeepsie, NY (US); Edward E. Kelley, Wappingers Falls, NY (US); Franco Motika, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 930 days.

(21) Appl. No.: 12/027,540

(22) Filed: Feb. 7, 2008

(65) Prior Publication Data

US 2009/0201131 A1 Aug. 13, 2009

(51) Int. Cl.
*G08B 13/14* (2006.01)

(52) U.S. Cl.
USPC ..... 340/572.1; 340/572.8; 340/568.7; 235/375; 235/379; 902/1; 902/4; 902/7

(58) Field of Classification Search
USPC ..... 340/572.1, 572.8, 568.7; 235/375, 379; 902/1, 4, 7
See application file for complete search history.

(56) References Cited

U.S. PATENT DOCUMENTS

| | | | | |
|---|---|---|---|---|
| 5,412,723 | A * | 5/1995 | Canetti et al. | 713/155 |
| 5,719,918 | A * | 2/1998 | Serbetciouglu et al. | 380/271 |
| 5,834,748 | A * | 11/1998 | Litman | 235/450 |
| 6,128,391 | A * | 10/2000 | Denno et al. | 380/283 |
| 7,170,391 | B2 | 1/2007 | Lane et al. | |
| 7,221,258 | B2 | 5/2007 | Lane et al. | |
| 7,246,754 | B2 * | 7/2007 | Siuta et al. | 235/492 |
| 7,584,885 | B1 * | 9/2009 | Douglass | 235/379 |
| 8,046,260 | B2 * | 10/2011 | Haddad et al. | 705/17 |
| 8,266,441 | B2 * | 9/2012 | Inskeep et al. | 713/185 |
| 8,341,397 | B2 * | 12/2012 | Leedom, Jr. | 713/156 |
| 8,342,392 | B2 * | 1/2013 | Kiliccote | 235/375 |
| 2003/0006121 | A1 * | 1/2003 | Lee et al. | 194/206 |
| 2005/0149741 | A1 * | 7/2005 | Humbel | 713/186 |
| 2005/0242176 | A1 * | 11/2005 | Roberge et al. | 235/383 |
| 2006/0115797 | A1 | 6/2006 | Gray | |
| 2007/0094152 | A1 * | 4/2007 | Bauman et al. | 705/67 |
| 2008/0106726 | A1 * | 5/2008 | Park | 356/71 |
| 2008/0265019 | A1 * | 10/2008 | Artino et al. | 235/379 |
| 2009/0045251 | A1 * | 2/2009 | Jaiswal et al. | 235/379 |

* cited by examiner

*Primary Examiner* — Steven Lim
*Assistant Examiner* — Ryan Sherwin
(74) *Attorney, Agent, or Firm* — Whitham, Curtis, Christofferson & Cook, P.C.; Ronald A. Kaschak

(57) ABSTRACT

A system and method of determining likelihood of counterfeiting without inspection of currency compares signals returned by uniquely customized RFID chips when interrogated, preferably incident to a transaction. The RFID information is compared to RFID information for bills known to be in circulation in order to validate a given currency bill. Usage patterns can be determined from statistical analysis of such reports and reported usage patterns will statistically differ significantly if not radically with the number of RFID chips returning the same RFID information and such differences will increase in either or both of geographic locations of reports and frequency of reports with increase of the number of bills having duplicated RFID chips. The basic infrastructure for practice of the invention is also capable of tracking genuine currency following, for example, a theft or other criminal activity.

19 Claims, 3 Drawing Sheets

EMBEDDED RFID VERIFIABLE CURRENCY

BACKGROUND OF THE INVENTION

1. Field of the Invention

The present invention generally relates to detection and tracking of counterfeit currency and, more particularly, to the use of a radio frequency identification chip embedded in the currency and detected during transactions to determine likely counterfeit currency without reliance on inspection thereof.

2. Description of the Prior Art

Public confidence in money is central to commercial transactions and economic stability, both of individual countries and the world economy, in general. In the United States and many other countries, the money supply is carefully regulated in order to maintain exchange rates and the basic value of the unit of currency, such as the U. S. Dollar. The introduction of counterfeit currency into circulation, as has been done from time-to-time for many years, is thus not only fraudulent but, if in sufficient quantity, may cause disruptions in the operation of the economy. This problem has been aggravated in recent years by the issuance in larger numbers of larger denominations of United States currency bills such that the impact of each bill, if counterfeit, is proportionately greater.

At the same time, counterfeiting has become more sophisticated and thus more difficult to detect to the point that numerous features which are difficult to duplicate or simulate are being incorporated into the currencies of the United States and other countries to maintain some possibility of detection of counterfeiting. However, such features, at best, only permit detection of individual counterfeit bills and all require careful inspection or at least a modicum of effort such as inspection of a watermark in the paper having a design matching another feature of the bill or by applying a chemical to a bill which contains another chemical; the two chemicals, in combination, producing a distinctive color.

At the present time, there are two general classes of counterfeit currency: counterfeit bills made by criminals not affiliated with any government and those made by persons which are, in fact, affiliated with a foreign government or political entity. The former are usually but not always easier to detect since they maybe of lesser quality or omit some features which are costly and are not usually made in economically significant numbers. On the other hand, the latter type of counterfeit bills may be of much higher quality and sophistication since such governments or political entities may have access to equipment comparable to equipment used by the United States for production of genuine currency and thus may be indistinguishable from genuine currency and can be produced in potentially significant quantity.

SUMMARY OF THE INVENTION

It is therefore an object of the present invention to provide a feature of currency allowing currency to be screened in quantity and tracked in use to detect likely instances of use of counterfeit currency.

It is another object of the invention to provide a system and methodology for screening currency in quantity and tracking of use of bills to detect anomalies indicating likely use of counterfeit currency.

In order to accomplish these and other objects of the invention, a method of detecting duplication of currency is provided comprising steps of interrogating a RFID chip embedded in a currency bill, receiving a response signal comprising RFID chip information, comparing the RFID chip information to RFID information of genuine currency for validation of a currency bill, comparing the validation to a previous validation; and determining the likelihood of existence of a duplicated RFID chip based on the comparison of said validation to a previous validation.

In accordance with another aspect of the invention, a system for determining likelihood of counterfeiting is provided comprising currency having an RFID chip embedded in a bill, one or more RFID chip readers for interrogating the RFID chip and receiving RFID information identifying the bill, wherein the RFID chip reader includes an arrangement for determination of its location and an arrangement for reporting the RFID information over a network, and an arrangement for comparing reports of corresponding RFID information with RFID information of genuine, currently circulating bills and times and locations of reports of identical RFID information.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
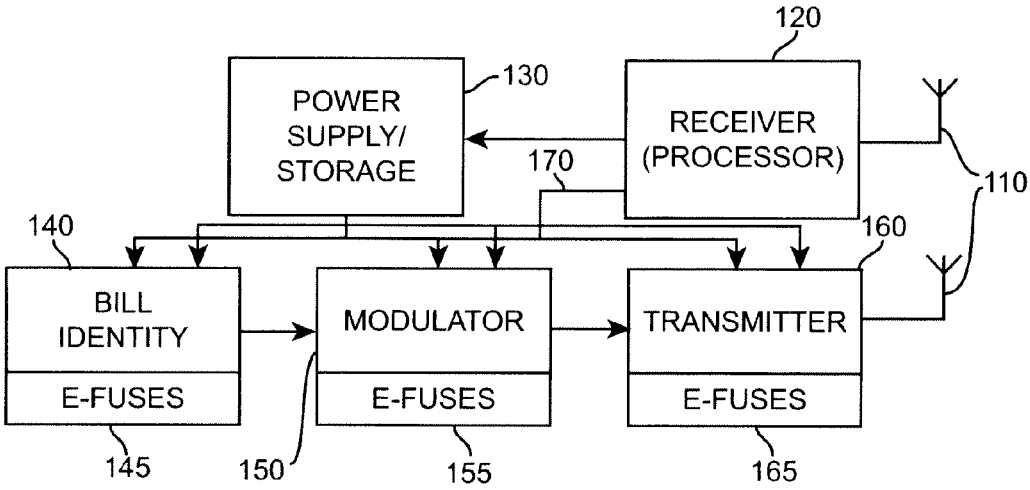
FIG. 1 is a block diagram of a radio frequency identification (RFID) chip suitable for practice of the invention.

Referring now to the drawings, and more particularly to FIG. 1, there is shown a block diagram of an RFID chip suitable for practice of the invention. The basic principles of RFID technology have been known and in commercial use for twenty years or more, generally as anti-theft systems in stores, libraries and the like. The basic elements of an RFID system are a radio frequency transmitter and receiver (TxRx) capable of transmitting and receiving a radio frequency signal over a short distance and a transponder. The transmitter radiates an interrogation signal which is detected by the transponder when brought within a suitable range of the transmitter. The transponder is arranged to then radiate or transmit a corresponding response signal which is detected by the receiver.

In early forms of RFID systems, the transponder was often embodied in a more or less bulky device often referred to as an RFID tag which could be attached to articles to be protected. The tag could then be removed from the article when purchased or when protection from removal from an area (e.g. a store) was no longer necessary. Less bulky forms of RFID tags have also been developed suitable for permanent attachment to articles such as foil antenna patterns with simple circuit elements such as a diode and, if desired, a simple switching device which can be reversibly activated and deactivated by, for example, a magnetic field. Such transponders could be permanently placed in, for example, the binding of a book or attached to a page of a document.

In basic RFID systems, the nature of the signal returned from the transponder could be very simple since the desired function was simply to detect the presence of an RFID tag in a particular location such as a exit from a room or building that would necessarily be traversed if the article was being removed form the room or building. It was typically sufficient for any RFID tag to be detected to determine that a theft was in progress and there was typically no need to distinguish between RFID tags.

In any event, there was also a practical limit on the amount of information which could be processed or used advantageously even though RFID tags could readily be configured to respond to interrogation at different radio frequencies and/or modulation and to respond with distinguishable signals so that individual RFID tags could be discriminated and identified.

More recent developments in reduction of cost of data processors of substantial processing power have led to much more sophisticated RFID systems where discrimination of individual RFID tags is, in fact, quite practical, leading to some new and highly useful applications such as substantially real-time inventory maintenance. At the same time, developments in semiconductor technology has led to reduction in cost and size of RFID tags to the point that uniquely customized RFID transponders can be fabricated at reasonable cost as semiconductor chips on extremely thin and flexible substrates; allowing such RFID chips to be located on or in virtually any article. Such chips can also be easily fabricated in a manner to resist damage by physical stress, folding, immersion in common liquids and the like.

Customization of such RFID chips by, for example, so-called e-fuses or other non-volatile memory structures where stored data is not only persistent but difficult to alter (or can be made so), allows many transponders to be simultaneously interrogated while supporting detection of individual transponder responses.

Referring again to FIG. 1, a block diagram of an RFID chip suitable for practice of the invention is shown. One or more antennas 110 are provided for reception of transmissions from an interrogation transmitter and returning detectable coded signals.

It is preferable for reasons of size to use a single antenna although two antennas are depicted for simplicity of illustration. The antenna(s) need not be fabricated on the RFID chip. An interrogation signal is received by receiver 120 and used to develop power for a response, for example, by rectification of the received interrogation signal (boosted in voltage by a transformer) and storage in a capacitor. Other ways of coupling power to an RFID chip are known to or foreseeable by those skilled in the art such as inductively coupling power to RFID chips at low frequency in advance of interrogation. In any event, the particular technique by which power is supplied to the RFID chip is not important to the successful practice of the invention.

The power thus obtained and stored is then applied to logic 140 to provide data corresponding to currency bill identity (e.g. a bill identity register), modulator 150 to apply a transmission protocol to the data and transmitter 160. It is preferred that each of the bill identifier 140, modulator 150 and transmitter 160 be associated with a bank of e-fuses or other non-volatile memory 145, 155 and/or 165 such that any or all of these functions may be customized. Thus, a theoretically unlimited number of unique transponder responses may be generated.

It is also possible, as a perfecting feature of the invention, to provide some degree of data processing capability in, for example, receiver 120, such that data in the interrogation signal may be used to alter the customized responses set in the e-fuse banks 145, 155 and/or 165 such as transmitting a time stamp and combining the time data logically with stored data in the response. Similarly, a register in any or all of elements 140, 150 and/or 160 could count, for example, the number of interrogations of the RFID chip or store any other data sequence transmitted during the interrogation for modification of the response signal as will be discussed in greater detail below. Any such feature may be applied singly or in combination to increase security and complicate counterfeiting and to facilitate validation of a currency bill as genuine with high confidence, again, without inspection.

Thus, using currently available RFID chips, it is possible to determine, for example, the contents of a large, sealed container such as a so-called containerized freight shipping container (although such containers are often of metal which may tend to shield RFID transmissions) which may contain hundreds or thousands of diverse individual articles or other container such as luggage or shipping boxes quickly and without access to the interior of the container or individual articles contained therein.

While such customization is well within the capabilities of the art at the present time, substantial infrastructure of substantial cost is, nevertheless, required to fabricate RFID chips that are unique and individually detectable.

The inventors have recognized that individual bills of genuine currency can also be validated in such a manner using embedded RFID chips and that the infrastructure required to provide similar unique RFID chips in counterfeit currency is unlikely to be available, particularly if the information coded therein as an incident of customization is closely regulated. That is, it is considered to be more likely that counterfeit bills will be fabricated which duplicate, as nearly as possible, only one or, at most, a small plurality of genuine currency bills. Thus, while it may be possible to duplicate the customization of an RFID chip of a single genuine bill or a small number of genuine bills, it is unlikely that unique RFID chips could be produced and included in a significant number of counterfeit bills. Moreover, the customization of genuine currency bills can be known by appropriate persons or officials but unlikely to be known or discoverable by counterfeiters and the RFID chip(s) of genuine currency must be duplicated in order to avoid immediate detection of invalid customization.

That is, while the function of an RFID chip can, in theory, be reverse-engineered and duplicated, if a wide variety of unique responses are available, the duplication of each RfID chip for each of a large number of presumably large denomination bills is not at all practical for a counterfeiter since each bill to be so duplicated would necessarily require possession by the counterfeiter and reading the RFID chip with a suitable reader as well as duplication of responses which, if made variable by the perfecting features of the invention alluded to above, would require significant testing and analysis. Such counterfeiting processes, while possibly avoiding being able to distinguish between genuine and counterfeit bills, would also be impractical, particularly on a large scale, since each genuine bill (and RFID chip) so duplicated and which must be acquired at face value or by theft would yield only one counterfeit bill. It is much more likely that a counterfeiter would make many copies of only one or a relatively small number of bills and RFID chips to at least avoid detection by the absence of an operable RFID chip even though the number of RFID chips which would provide a response including identical bill identification information upon interrogation would be increased. The detection of increase of the number of identical RFID information is thus a basic principle of detection of the likelihood of counterfeiting in accordance with the invention.

Thus, it is considered to be virtually certain that a counterfeit currency bill having an RFID chip will include customization which duplicates the customization of an RFID chip in a genuine currency bill while the corresponding genuine currency bill must remain in circulation for the counterfeit currency bill to be of any benefit to the counterfeiter. Moreover, it is considered most likely that an RFID chip from a genuine bill will be duplicated many times in any counterfeiting operation of economically significant scale. These circumstances thus provide for detection of likely counterfeiting through detection of usage patterns of currency bills based on discrimination of individual RFID chips embedded therein in accordance with the principles of the invention.

Specifically, uniquely customized RFID chips are embedded in at least larger denominations of genuine currency as it is manufactured. The unique customization, preferably corresponding in some way to the serial number and possibly also reflecting the currency series, date and/or the issuing Federal Reserve Bank, can be read by any corresponding RFID chip reader. It should be understood that such information can be directly used for customization of the RFID chip in each genuine currency bill or some coding scheme could also be employed. For example, the serial number (and possibly other information) or a portion thereof (e.g. most significant or least significant digits or a combination of selected digits) could be used as an offset address of a particular range of pseudo-random numbers, with or without one or more layers of encryption, can be used equally well as a surrogate for the serial number and/or any other additional or alternative information it may be desirable to include and that any such additional coding and/or encryption increases the need for a counterfeiter to scrupulously duplicate the response of a genuine RFID chip in order to have a counterfeit bill validated as genuine and immediate detection of counterfeiting avoided. Such surrogate information may be regarded as essentially a highly secure key for determination of the identity (e.g. serial number) of genuine currency.

Such readers can be located at likely points of transactions such as stores, banks and the like or may be provided at points of inspection of other objects, such as luggage at transportation terminals, customs at points of entry to or exit from a country or the like. Thus, a reader is preferably used to validate each currency bill used in a transaction or transported by public transport or across (e.g. national) boundaries as an initial safeguard against counterfeiting (e.g. by detecting bills without an RFID chip or having a chip with invalid customization). It should be understood that currency bills are taken out of circulation if damaged or unduly worn, thus "retiring" the customization of that currency bill. If the currency bill has been duplicated by a counterfeiter and the duplicate, counterfeit currency bill remains in circulation (or vice-versa), that circumstance can be detected by such a validation process where the customization read from a bill is checked against customizations of currency bills known to be in circulation which will not include customizations of currency bills which have been removed from circulation.

Additionally, even for currency bills which are initially validated in the manner described above, the use of RFID chips in genuine currency, which must be scrupulously duplicated in a counterfeit currency bill in order to be similarly validated, allows usage patterns to be detected which will indicate a likelihood of counterfeiting having taken place. Specifically, it is preferred that RFID chip readers also record the denomination of the bill (as indicated by the RFID chip which may or may not correspond to the denomination of a counterfeit bill), the location of the validation as may be determined, for example, by a global positioning system (GPS) receiver located in or connected to the reader, and the date and time of the validation. Thus, if a genuine currency bill and one or more counterfeit currency bills having RFID chips which duplicate the RFID chip or the RFID information returned upon interrogation of the genuine currency bill are in circulation and are validated numerous times within a short period of time, particularly if locations of validations are widely separated or particularly numerous, there is a high probability that counterfeit currency bills are in circulation.

The same conclusion could be drawn from the same customization being detected more than once in a single transaction or plural, identical RFID chips being detected concurrently, as might be indicated, for example, by transponder response signal strength, within a single transaction or in separate transactions within a particularly short period of time particularly if geographically separated. By the same token, apparently normal usage patterns which take place in widely separated areas (e.g. separate, apparently normal frequency of usage patterns on opposite coasts of the U.S. would likely indicate a duplicated RFID chip). In short, either location or frequency of usage may be used alone or in combination to infer that a given currency bill or at least the RFID chip therein has been duplicated and that a counterfeit bill is in circulation.

It should also be appreciated that such information is also adequate to track the location of stolen currency. For example, an inventory of cash on hand in individual currency bills could be easily, automatically and transparently maintained at any location or establishment having an RFID chip reader. If such currency was thereafter stolen or if information regarding serial numbers of stolen genuine (or possibly counterfeit) currency bills is otherwise available, such serial numbers and/or RFID chip customizations can be circulated and reported immediately when read and validated, including the location where the validation occurred.

Figure 2:
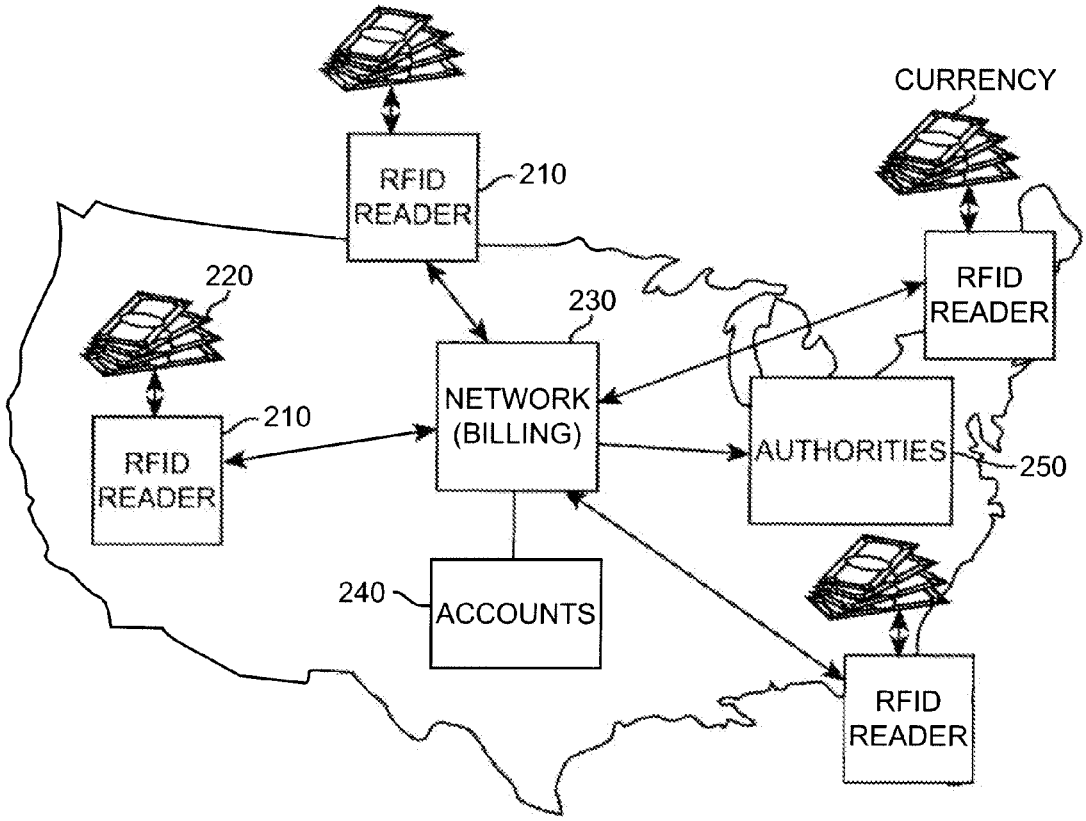
FIG. 2 is a schematic diagram of a system for practice of the invention, and FIGS. 3A and 3B comprise a flow diagram illustrating a preferred methodology of the invention.

Such information can be collected and correlated by a system similar to that depicted in FIG. 2. As schematically depicted in FIG. 2, RFID readers can be applied to currency concurrently throughout a geographical region such as the United States. As discussed above, it is desirable for such readers 210 to include an arrangement such as a network, including the Internet, for communicating with other readers or one or more central report collection point(s) 230 which would preferably have information regarding RFID information of genuine and currently circulating bills resident thereon or available thereto which can be updated from an accounting arrangement 240 as currency bill are introduced into or retired from circulation. If the invention is practiced as a commercial service, billing for services provided would also be preferably be conducted from such central report collection point(s) 230. Such a central report collection point of one or more readers, singly or in combination can relay reports which are likely to indicate currency or RFID duplication to authorities 250 for appropriate corrective action to be taken.

Figure 3A:
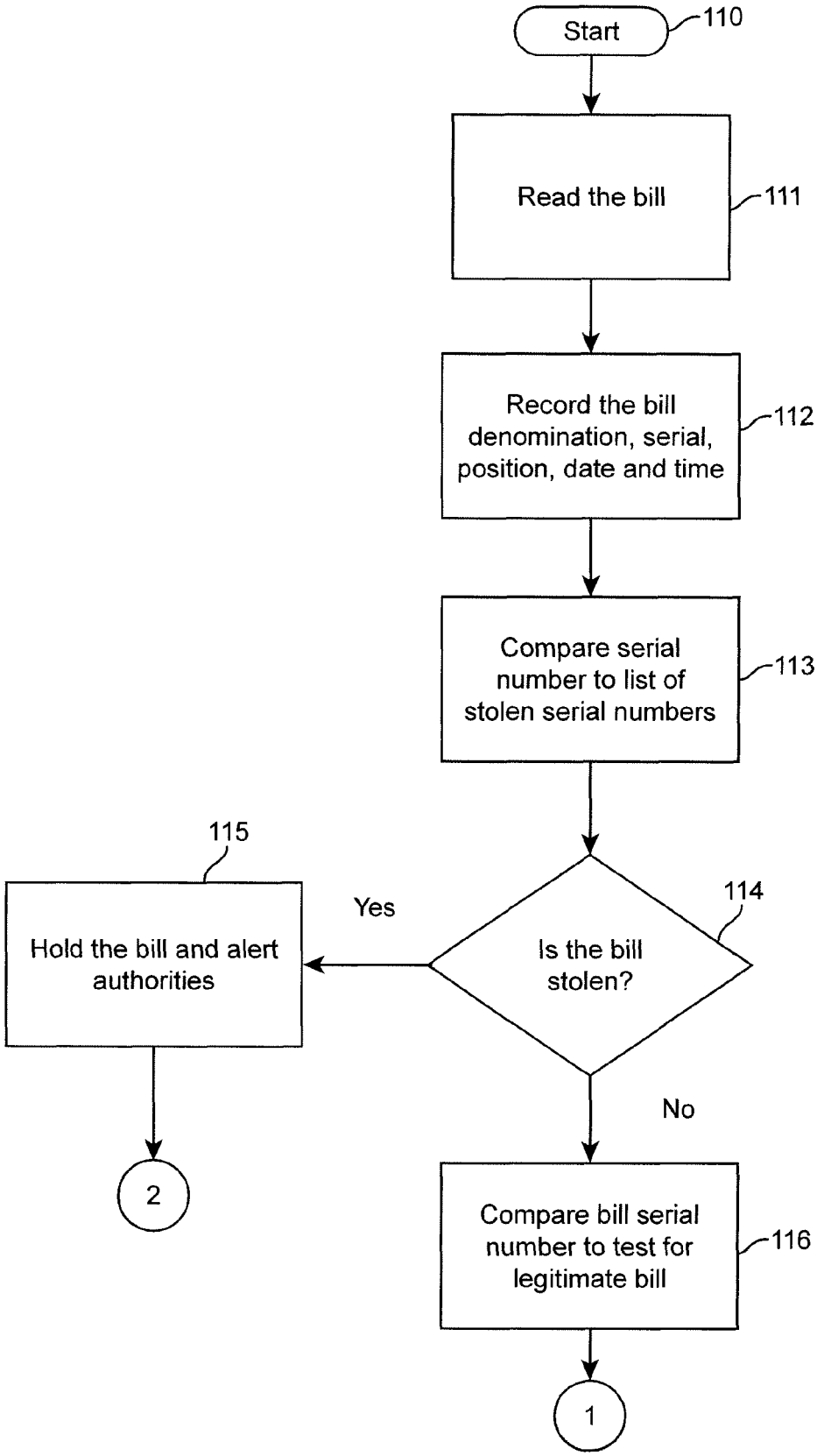
Figure 3B:
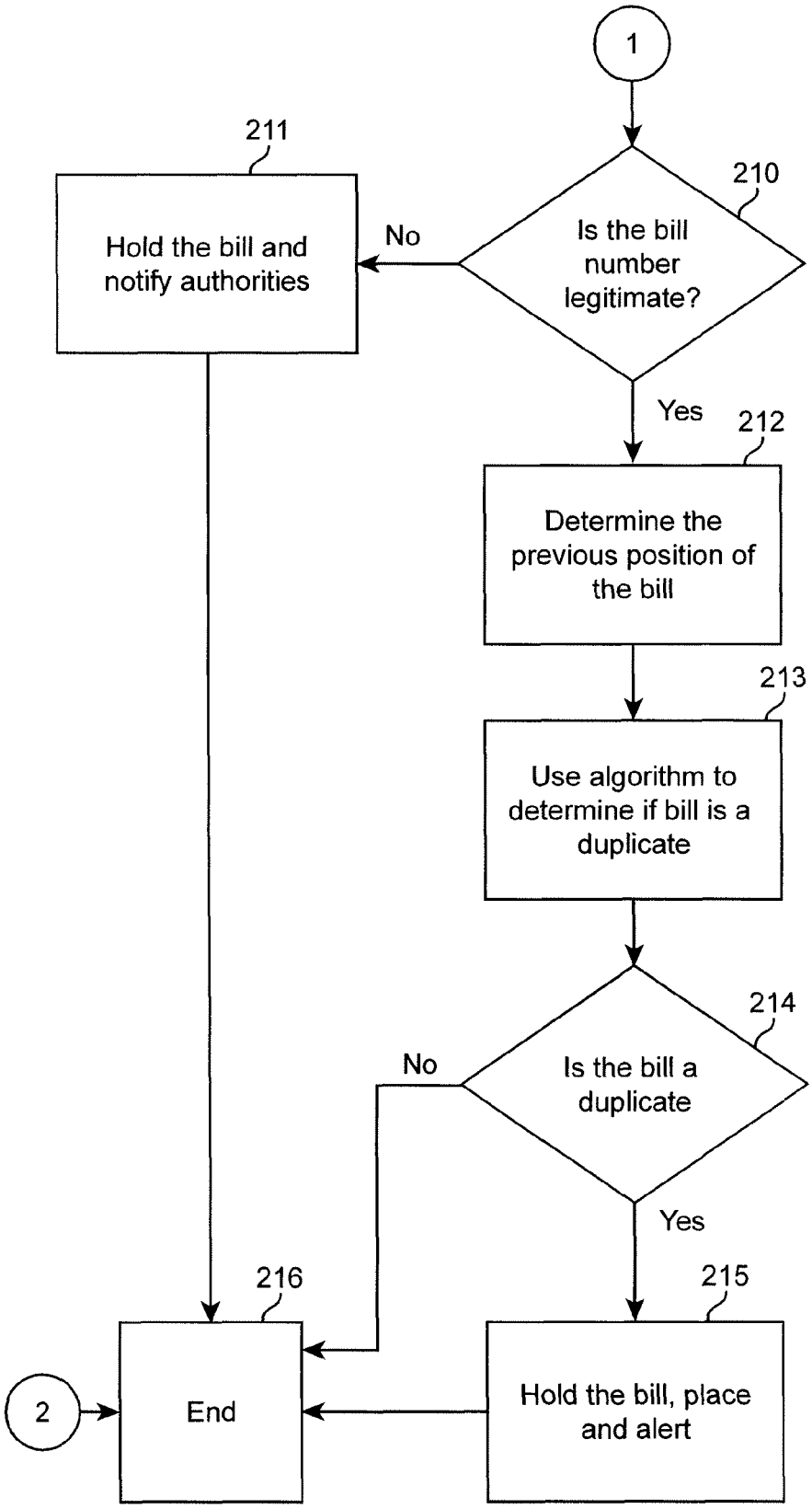

Referring now to FIGS. 3 and 4, a preferred methodology for the practice of the invention to detect likely counterfeiting and/or track stolen currency will now be described. Reference numeral 110 indicates the start of the process. The RFID chip of a currency bill is initially read by sending an interrogation signal and receiving a transponder response signal from the RFID chip and the bill denomination, serial number (or surrogate information such as a number or characters corresponding thereto), location/position, date and time are recorded at indicated at steps 111 and 112, respectively. Then, optionally, the serial number can be compared with lists of serial numbers of stolen currency (113) and a determination made if a bill is reported as stolen (114). If so, the operator of the RFID chip reader can be so informed so that the bill can be held and authorities alerted, as indicated at step 115. (It is considered reasonable to assume that a stolen currency bill is likely to be genuine and thus additionally testing for counterfeiting is likely to be unnecessary and the process can immediately end, through cardinal point 2, for that particular currency bill. Whether or not that is the case, the most important action in the case of detection of stolen currency will have been taken at step 115 and any detection of counterfeiting can be deferred. Alternatively, the process can continue at step 116 rather than ending, as illustrated.)

If the currency bill is not determined to be stolen, the RFID customization (e.g. serial number, denomination and the like) in the response signal is compared to known customizations for genuine currency bills at step 116 and (proceeding through cardinal point 1) it is determined if the currency bill is legitimate/genuine at step 210. If not, the operator of the RFID chip reader is notified to hold the bill and notify authorities at step 211 in a manner similar to that described above for a stolen bill.

If the information returned by the RFID chip (e.g. serial number or surrogate therefor) corresponds to a bill in circulation, the bill is validated. It should be noted that a counterfeit bill having an RFID chip scrupulously duplicated in accordance with an RFID chip in a genuine currency bill will be validated at this point.

Alternatively, the serial number of the genuine bill corresponding to the information returned by the RFID chip could be returned for comparison with the particular bill that has been read. However, such inspection is not preferred since such a comparison would not necessarily be indicative of counterfeiting since the printed serial number on the bill could also be made to correspond to genuine currency and the burden of such inspection and comparison is deemed to be generally unjustified, especially where it can be assumed that genuine bills will be encountered and validated more often than counterfeit bills. Instead, the following steps, particularly in combination with location reporting is considered much more convenient and entirely adequate to detect that counterfeiting has occurred and the scale on which counterfeiting appears to have taken place.

Specifically, when a currency bill is validated, the previous reported location of the bill is determined at step 212. An algorithm which may be empirically or statistically determined may then be applied to the location of the present validation and the previous validation (and possibly previous validations) to determine if the bill that has been validated is a duplicate. The basic principle of such an algorithm in accordance with the invention is to compare the distance and time between validations to determine the likelihood that the bill which has been validated in the current process is the same bill as previously validated in a previous iteration of the process. That is, a bill of a given denomination will be used in transactions or other occasions where validation may be appropriate at an average frequency and will move geographically in the course of normal circulation at a rate which may be empirically determined, on average, and significant variations from an average or mean value can be statistically established. If a genuine currency bill and a single counterfeit bill having a duplicated RFID chip are both in circulation, the time between validations of one or the other of the bills will be significantly more frequent and the geographical distribution of validations will generally become increasingly greater. While substantial variation in usage patterns for a single (e.g. genuine) bill may exhibit substantial variation without being necessarily statistically significant, as may be determined by collection of usage patterns from reported validations, the different usage reporting pattern likely to result from both a genuine bill and a single counterfeit bill being concurrently in circulation will almost invariably be statistically significant. The differences from average circulation will become even more readily evident if more than one duplicate of a genuine bill is in circulation, as is extremely likely to be the case since fewer duplicates of a given bill imply a greater number of genuine bills which must be duplicated, as discussed above. Any algorithm which is designed to detect such variations will be adequate for the successful practice of the invention and will reliably indicate if any particular bill validated is likely to be a duplicate of another bill having an identical RFID chip which is also in circulation, as illustrated in steps 213 and 214. If the bill is not likely to be a duplicate, the process can end (216) and may be reiterated for another bill or, if the existence of a duplicate is likely, the operator of the RFID chip reader may be notified to hold the bill and notify authorities in step 215, as before.

Remedial action which may be taken may vary widely, as circumstances dictate. It should be recalled that the invention ultimately detects the likelihood of duplication of an RFID chip and, accordingly, the likelihood that counterfeiting has taken place but does not establish whether or not a particular bill in question is a counterfeit; a circumstance which may not be detectable for a counterfeit bill of sufficient quality. However, the seizure of one duplicate bill can take place immediately and others may be seized as validation is attempted (e.g. when one bill is removed from circulation, any other duplicate will not be validated). In appropriate circumstances, a bill found likely to be a duplicate or to have been duplicated (e.g. a genuine bill) can be replaced with another bill known to be genuine and unsuspected of duplication. Thus the invention can be very effective in rapidly removing counterfeit and duplicated bills from circulation, particularly since no duplicate bill will be validated, even if genuine, after another bill returning the same RFID chip information is removed from circulation. The location information provided by the invention incident to validation also speeds reportage to authorities and appropriate corrective action to apprehend counterfeiters or expose counterfeiting operations. Thus, the methodology of the invention comprises the operations of receiving a signal from a user requesting the service of checking for likely counterfeit bills, analyzing a RFID response signal to an interrogation of one or more bills, optionally checking for stolen bills, determination of the likely existence of duplicate bills and registering stolen and/or counterfeit bills. It is contemplated that the meritorious effects of the invention are commercially valuable as a service and use of the system could be recorded and billed to users as may be deemed appropriate.

In view of the foregoing, it is seen that the invention provides a system and methodology for detecting likely instances of counterfeiting without reliance upon inspection of individual currency bills as well as facilitating the removal of possibly counterfeit bills and bills which may have been duplicated from circulation. Security and the likelihood that counterfeiters will be effectively forced to duplicate RFID chips is enhanced by coding and/or encryption in surrogate information for identification of individual currency bills. In this regard, since the logic which can be included in an RFID chip is limited only by the area of the RFID chip, various enhancements such as providing for alteration of surrogate information in accordance with variable conditions such as the date and time of validation, the number of validations performed on a given bill (which could be used to cause immediate invalidations of all bills which are duplicates or which may have been duplicated upon the validation of any single counterfeit bill), use of a pseudo-random sequence for coding or encryption or the like, any of which could also be used in combination with others or only on a predetermined portion of the returned RFID information.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A method of detecting duplication of currency, said method comprising steps of:

interrogating a radio frequency identification (RFID) chip embedded in a currency bill to cause said RFID chip to return stored information, said stored information including information uniquely identifying said currency bill;

receiving a response signal from said RFID chip comprising RFID chip information;

comparing said RFID chip information to RFID information of currently circulating genuine currency, said comparing step providing a validation of said currency bill if said RFID chip information corresponds to said RFID information of currently circulating genuine currency, said comparing step providing an indication that said currency bill is not legitimate if said RFID chip information does not correspond to said RFID information of currently circulating genuine currency;

if said validation is provided, comparing said validation to a previous validation; and determining a likelihood of a duplicated RFID chip based on said comparison of said validation to said previous validation, and altering said RFID chip by storing surrogate information on said RFID chip, which surrogate information is a surrogate for and determined from said information uniquely identifying said currency bill and constitutes a highly secure cryptographic key for determining an identity of said currency bill and which varies in accordance with variable conditions associated with a given validation so as to make it unlikely that said RFID chip has been duplicated.

2. The method as recited in claim 1 wherein existence of a duplicated RFID chip is determined to be likely based on a time duration between said validation and said previous validation.

3. The method as recited in claim 1 wherein existence of a duplicated RFID chip is determined to be likely based on a time duration and geographic separation between said validation and said previous validation.

4. The method as recited in claim 1 wherein existence of a duplicated RFID chip is determined to be likely based on geographic separation between said validation and said previous validation.

5. The method as recited in claim 1 wherein said RFID information includes bill denomination, series, bank identification and data corresponding to a serial number.

6. The method as recited in claim 5 wherein said data corresponding to a serial number contains said serial number.

7. The method as recited in claim 1, including further steps of:

causing alteration of customized responses set in said RFID chip to facilitate validation of said currency bill, and altering said RFID information of said currently circulating genuine currency to include said alteration of said response signal.

8. The method as recited in claim 1, including a further step of detecting relative signal strength of said response signal.

9. The method of claim 1 wherein said variable conditions are selected from the group consisting of a date or time of validation, a geographic location of validation, and a pseudo-random sequence for coding or encryption.

10. A system for determining likelihood of counterfeiting, said system comprising currency having a radio frequency identification (RFID) chip embedded in each currency bill, said RFID chip including storage to information uniquely identifying said currency bill and additional alterable information, one or more RFID chip readers for interrogating an RFID chip in a currency bill and receiving RFID chip information identifying said currency bill, wherein each of said one or more RFID chip readers include a means for determination of its location and means for reporting said RFID chip information over a network, means for comparing RFID chip information obtained using said one or more RFID chip readers with RFID information of genuine, currently circulating bills, said means for comparing providing a validation of said currency bill when said RFID chip information corresponds to said RFID information of genuine, currently circulating bills, said means for comparing permitting comparing said validation with a previous validation of said currency bill and permitting determination of a likelihood of duplication of said RFID chip based on a comparison of said validation with said previous validation; and means for altering said RFID chip information by storing surrogate information on said RFID chip, which surrogate information is a surrogate for and determined from said information uniquely identifying said currency bill and constitutes a highly secure cryptographic key for determining an identity of said currency bill and which varies in accordance with variable conditions associated with a given validation so as to make it unlikely that said RFID chip or said currency bill has been duplicated.

11. The system as recited in claim 10, wherein said means for comparing includes means for collecting statistical information regarding frequency of reports of identical RFID chip information.

12. The system as recited in claim 11, wherein said means for comparing compares time separation of reports of identical RFID chip information with said statistical information regarding frequency of reports.

13. The system as recited in claim 10, wherein said means for comparing compares locations of reports of identical RFID chip information.

14. The system as recited in claim 10, wherein said comparing means compares both time and location separation between reports of identical RFID chip information.

15. The system as recited in claim 10, wherein said RFID chip embedded in each currency bill contains data corresponding to a serial number of said currency bill.

16. The system as recited in claim 10, further including means for collecting usage patterns for currency from reports by said one or more RFID chip readers.

17. The system as recited in claim 10, further including:

means for causing alteration of customized responses set in said RFID chip information to facilitate validation of said currency bill, and means for altering said RFID information of said currently circulating genuine currency to include altered RFID chip information.

18. The system as recited in claim 10, wherein said one or more RFID chip readers provide for detection of a relative signal strength of a response signal from said RFID chip embedded in each currency bill.

19. The system of claim 10 wherein said variable conditions are selected from the group consisting of a date or time of validation, a geographic location of validation, and a pseudo-random sequence for coding or encryption.

* * * * *